United States Patent [19]

Watanabe

[11] Patent Number: 4,573,815

[45] Date of Patent: Mar. 4, 1986

[54] PRINTER

[75] Inventor: Yasunori Watanabe, Nagoya, Japan

[73] Assignee: Brother Kogyo Kabushiki Kaisha, Nagoya, Japan

[21] Appl. No.: 653,077

[22] Filed: Sep. 21, 1984

[30] Foreign Application Priority Data

Sep. 30, 1983 [JP] Japan ..... 58-152834[U]

[51] Int. Cl.[4] ..... B41J 13/14

[52] U.S. Cl. ..... 400/642; 400/647.1

[58] Field of Search ..... 400/646, 647, 647.1, 400/716, 693, 693.1, 690.4, 680, 619, 578, 645.2, 645.3, 645.4, 645.5, 642, 645, 645.1, 576; 312/208

[56] References Cited

U.S. PATENT DOCUMENTS

| | | | |
|---|---|---|---|
| 1,063,924 | 6/1913 | McLaughlin | 400/578 X |
| 1,244,011 | 10/1917 | Anderson | 400/645.5 |
| 1,327,075 | 1/1920 | Zaiss | 400/645.4 X |
| 2,107,370 | 2/1938 | Dobson | 400/576 X |
| 2,178,196 | 10/1939 | Witmer | 312/208 |
| 2,209,705 | 7/1940 | Pfau | 400/693.1 |
| 3,333,671 | 8/1967 | Rohde | 400/646 X |

OTHER PUBLICATIONS

IBM Technical Disclosure Bulletin vol. 24 No. 8 Jan. 1982 p. 4348 "Cover Section for Paper Opening of a Printer" by Mott et al.

*Primary Examiner*—Edgar S. Burr
*Assistant Examiner*—Charles A. Pearson
*Attorney, Agent, or Firm*—Browdy and Neimark

[57] ABSTRACT

A printing device comprising a main cover having an opening which is located above a print mechanism and extends over a printing width of the print mechanism; a paper holder mounted on the main cover, pivotally at a position adjacent to a rear end of the opening, to permit a pivotal motion between a closed position for covering the opening and an open position wherein the paper holder uncovers the opening, the paper holder supporting and guiding a print paper supplied to the print mechanism when the paper holder is in the open position; and a paper guide pivotally mounted adjacent to a front edge of the opening of the main cover, and retained by a biasing member in a paper-guiding position thereof wherein the paper guide extends diagonally in a rear upward direction from a pivot thereof over the print mechanism and guiding the print paper which is fed backwardly by the print mechanism when the paper holder is in the open position, the paper guide being pushed downwardly by the paper holder and pivoted to a storage position thereof against a biasing force of the biasing member when the paper holder is in the closed position.

13 Claims, 4 Drawing Figures

PRINTER

BACKGROUND OF THE INVENTION

The present invention relates generally to a printer such as a typewriter or similar device. More particularly, the invention is concerned with such a printer which includes a print mechanism wherein a print head moves along a platen for printing characters on a sheet of paper which is fed perpendicularly to the platen.

Printers of this type are usually provided with a main cover which covers a print mechanism. In a portion of the main cover located above the print mechanism, there is provided an opening in which are disposed a paper holder for supporting and guiding a print paper which is supplied to the print mechanism, and a paper guide for guiding the printed paper backwardly.

If these paper holder and guide are small, the print paper cannot be fully guided and supported. If the paper holder and guide are relatively large in size, it is convenient to support and guide a print paper. However, the larger the paper holder and guide are, the less convenient it is to carry the printer because the paper holder and guide project a larger distance upwardly from the main cover of the printer.

SUMMARY OF THE INVENTION

It is accordingly an object of the present invention to provide a printer which is handy to carry and which includes a paper holder and a paper guide which allows easy setting of a print paper into the printer.

According to the invention, there is provided a printing device which includes a print mechanism wherein a print head moves along a platen for printing characters on a sheet of paper which is backed up by the platen and fed perpendicular to a longitudinal direction of the platen, comprising:

a main cover having an opening which is located above the print mechanism and extends over a printing width of the print mechanism;

a paper holder mounted on the main cover, pivotally at a position adjacent to a rear end of the opening, to permit a pivotal motion between a closed position for covering the opening and an open position wherein the paper holder uncovers the opening, the paper holder supporting and guiding a print paper supplied to the print mechanism when the paper holder is in the open position; and a paper guide pivotally mounted adjacent to a front edge of the opening of the main cover, and retained by biasing means in a paper-guiding position thereof wherein the paper guide extends diagonally in a rear upward direction from a pivot thereof over the print mechanism and guiding the print paper which is fed backwardly by the print mechanism when the paper holder is in the open position, the paper guide being pushed downwardly by the paper holder and pivoted to a storage position thereof against a biasing force of the biasing means when the paper holder is in the closed position.

In the printing device constructed as described above, the print paper will be easily set in the printing device when the paper holder is in the open position because the paper holder can support and guide the print paper which is supplied to the printing device and also because the print paper is fed backwardly, guided by the paper guide which is biased by the biasing means so that the rear end thereof is directed diagonally toward a top rear direction of the printing device. Thus, the typewriter using the printing device of the invention is very handy to carry when the paper holder is in the closed position since the paper guide is pressed downwardly by the paper holder and pivoted to the storage position against the aforementioned biasing force so that the paper holder and the paper guide do not project exceedingly upwardly from the main cover.

BRIEF DESCRIPTION OF THE DRAWING

The foregoing and additonal objects, features and advantages of the present invention will be better understood from reading the following detailed description of the preferred embodiment taken in connection with the accompanying drawing in which.

DETAILED DESCRIPTION OF THE PREFERRED EMBODIMENT

Figure 1:
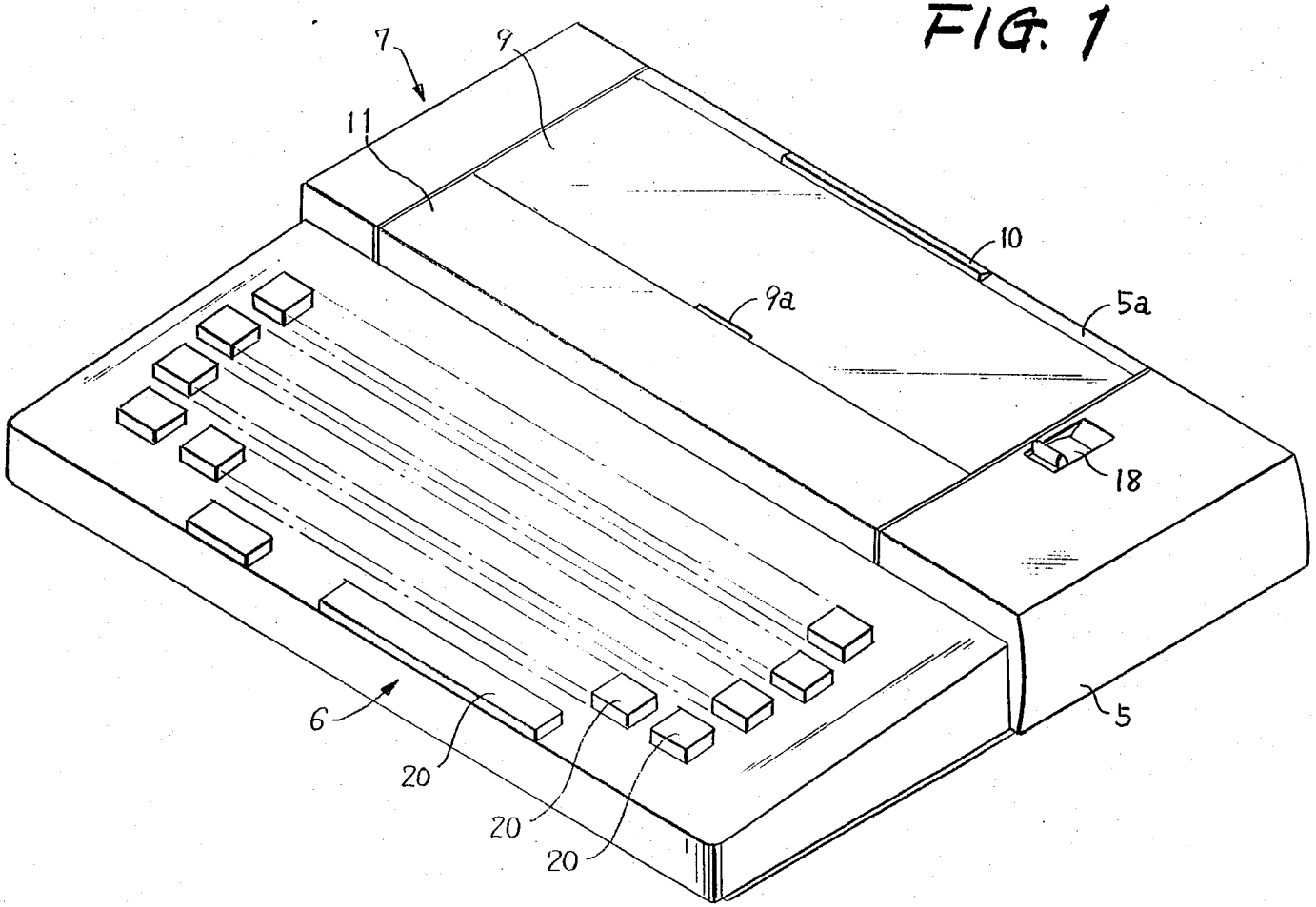
FIG. 1 is a perspective view of the typewriter which includes one embodiment of a printing device of this invention.

To further clarify the present invention, a preferred embodiment of a printing device as applied to a typewriter will be described in greater detail, referring to FIGS. 1–4.

The typewriter is provided with an input device 6 and a printing device 7. The input device 6 comprises many input keys 20 which are arranged in front of a main cover 5. The printing device 7 is provided in the rear section of the typewriter. The main cover 5 has an opening 8 (FIG. 4) which is formed over an entire printing width of the printing device 7. The opening 8 is covered with a paper holder 9 which is generally a rectangular flat plate which covers the opening 8 when the typewriter is not used.

The paper holder 9 is pivotally mounted on the main cover 5 to permit a pivotal motion substantially about its rear edge, between a closed position for covering the opening 8 and an open position wherein the paper holder 9 uncovers the opening 8. In the open position, the paper holder 9 is held in contact with a paper holder stopper 10 which is a protrusion projecting upwardly from a top surface of a central part of a rear wall **5*a* of the main cover 5. The stopper 10 is formed in a longitudinal direction of the rear wall 5*a*, which is disposed parallel to a rear edge of the paper holder 9. In the open position, the paper holder 9 extends obliquely in a rearward and upward direction, and is able to support and guide a print paper which is supplied to the printing device 7. The central portion of the front edge of the paper holder 9 has a notch 9*a* for easily pivoting the paper holder 9** with a finger into its open position.

Figure 2:
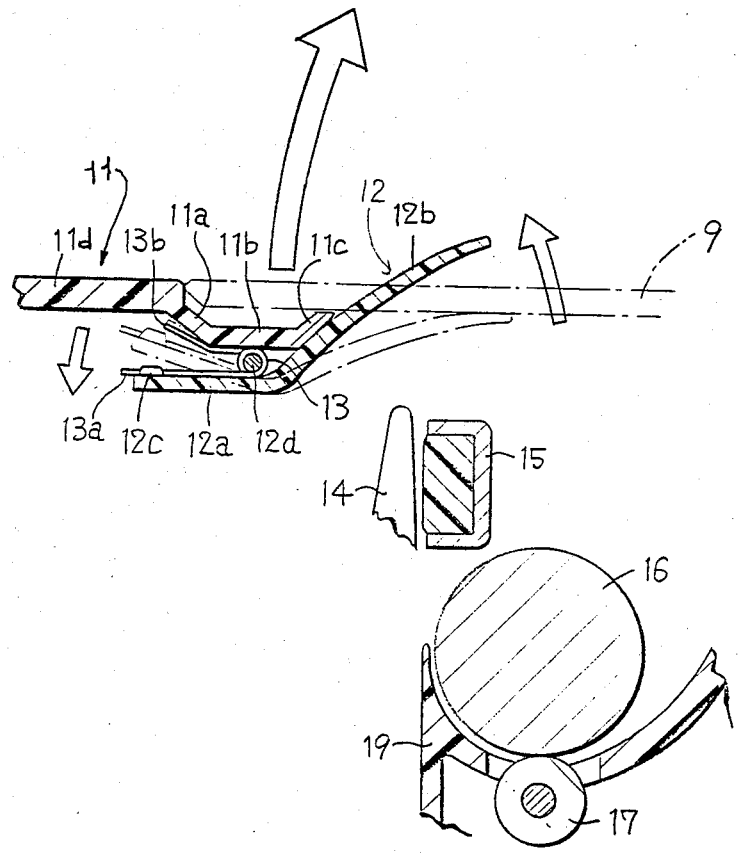
FIG. 2 is a cross-sectional view illustrating only an essential part of the invention.

In front of the paper holder 9, an auxiliary cover 11 is removably attached to the main cover 5 to cover a space communicating with and in front of the opening 8. The auxiliary cover 11 has a flat forward portion 11' and an inclined portion **11*a* which extends obliquely downwardly from the flat portion in a rearward direction as shown in FIG. 2. Backwardly from a rear edge of the inclined portion 11*a***, a slab-shaped foot portion 11*b* is formed which extends parallel to the flat portion 11'. The foot portion 11*b* is spaced a certain distance from the flat portion 11' in a direction perpendicular to the plane of the flat portion 11'. Further, on both longitudinal ends of a rear edge of the foot portion 11*b* are provided paper holder supports 11*c* which project upwardly and rearwardly toward the opening 8. When the paper holder 9 is in the closed position and covers the opening 8, a bottom or rear surface of the paper holder 9 is in contact with top end faces of the paper holder supports 11*c*. In this closed position, the paper holder 9 is a certain distance separated upwardly from the foot portion 11*b*, and a front or top surface of the paper holder 9 and a top surface of the flat portion 11' are located at substantially the same level, i.e., substantially flush with each other. Side guards 11*d* project downwardly from both longitudinal ends of the foot portion 11*b* of the auxiliary cover 11 and are provided with pivot holes 11*e* for pivotally mounting a paper guide 12. Thus, the main cover 5 and the auxiliary cover 11 cooperate to constitute covering means.

Figure 3:
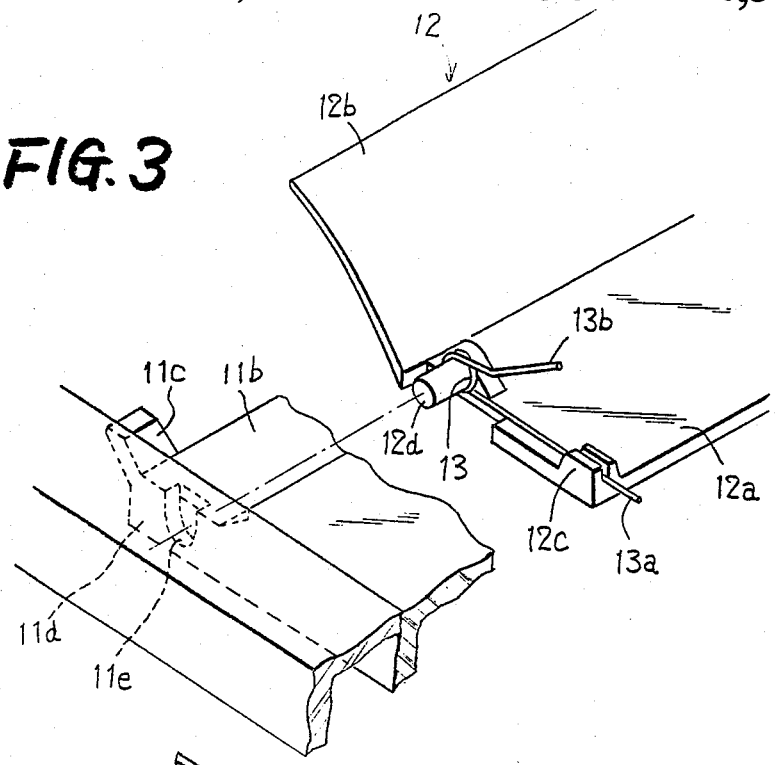
FIG. 3 is a perspective view illustrating a paper guide mounting portion and vicinities thereof.
Figure 4:
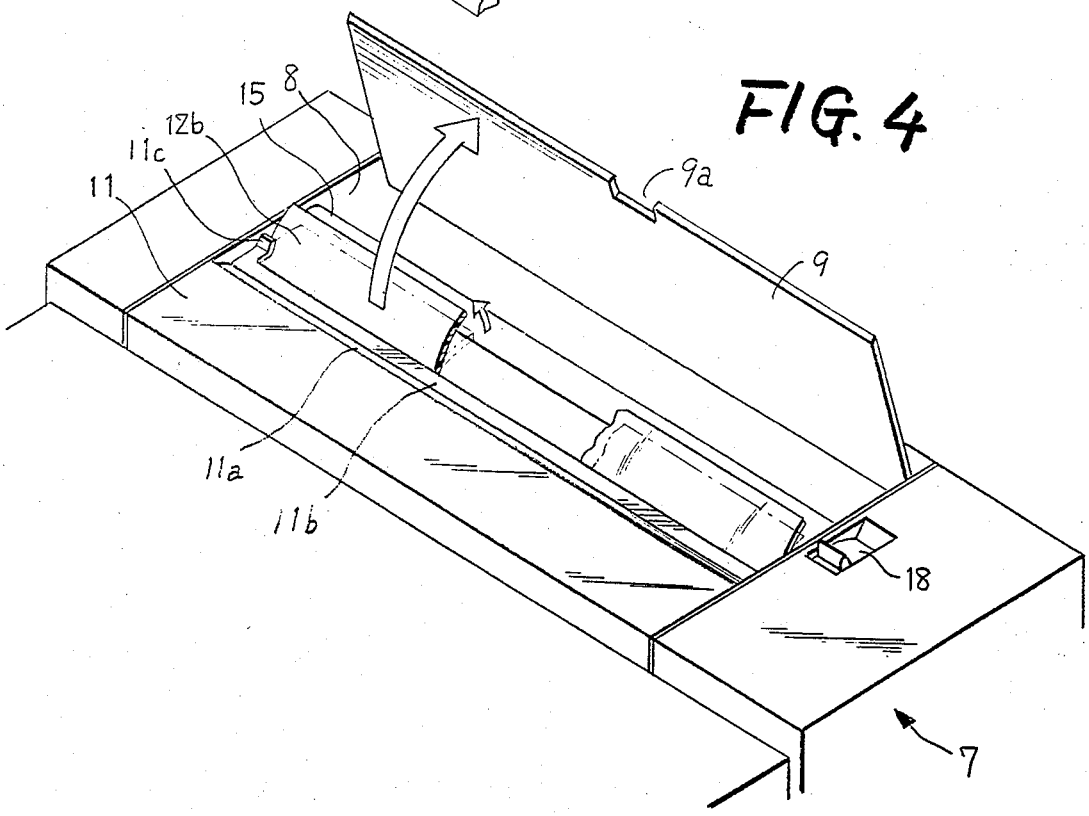
FIG. 4 is a perspective view illustrating only a part of the printing device when the paper holder is in the open position.

The paper guide 12 comprises, as shown in FIG. 3, an overhang 12*b* and a slab-shaped extension 12*a* extending forwardly at a suitable angle relative to the overhang 12*b*. The extension 12*a* is provided with engagement portions 12*c* at right and left front corner portions, respectively. The engagement portions 12*c* extend upwardly from the extension 12*a* and have a groove for retaining a lower arm 13*a* of a paper guide spring 13 in the form of a torsion spring having a pair of arms 13*a* and 13*b*. The upper arm 13*b* is in contact with a bottom of the inclined portion 11*a* of the auxiliary cover 11 as shown in FIG. 2. Both sides of an area of the paper guide 12 wherein the extension 12*a* and the overhang 12*b* join are provided with a pair of pivots 12*d* which extend from its opposite longitudinal ends so that the pivots 12*d* are fitted into corresponding pivot holes 11*e* of the auxiliary cover 11. The overhang 12*b* is warped so as to have an arcuate cross section in a plane perpendicular to the pivot axis of the paper guide 12 and is disposed to cover the top of a print mechanism of the printing device 7 over the entire printing width.

The paper guide spring 13 is wound around the pivot 12*d* of the paper guide 12, and one end of spring 13, i.e. the lower arm 13*a*, is engaged with the engagement portion 12*c* while the other end thereof, i.e. the upper arm 13*b*, is in contact with the bottom or lower surface of the auxiliary cover 11.

The print mechanism located in the bottom of the opening 8 is provided with a thermal print head 14, a platen 15, and a pair of paper feed rollers 16 and 17. The platen 15 is arranged in a long distance in a horizontal direction and the print head 14 is disposed in front of the platen 15 in opposed relation with each other. The print head 14 is moved between a position wherein the print head 14 comes into close contact with the platen 15 and a position wherein the print head 14 is separated therefrom by operation of a print head release lever 18 which projects upwardly through a hole formed in the main cover 5 on the right side of the opening 8 as shown in FIG. 1. Under the platen 15 are disposed the pair of paper feed rollers 16 and 17 and a bottom paper guide 19. The pair of paper feed rollers 16 and 17 are made of soft material and are configured to come into close contact with each other in a vertical direction. The lower paper feed roller 17 is carried by the bottom paper guide 19. When a power switch is turned on to start operation of the typewriter and a paper feed key of the input device 6 is pressed, the upper paper feed roller 16 is rotatedby a paper feed drive (not shown), and a print paper is fed toward the print head 14 between the upper and lower paper feed rollers 16 and 17, guided by the bottom paper guide 19.

The foregoing preferred embodiment of the present invention functions a follows.

Firstly, the operator pulls the paper holder 9 upwardly with a finger engaging the notch 9*a* of the paper holder 9, which is in the closed position, to uncover the opening 8, and pivots the paper holder 9 clockwise (in FIG. 2) to its open position until it comes into contact with the paper holder stopper 10, thereby allowing a print paper supplied to the printing device 7 to be supported and guided.

The paper guide 12 is located in the lowermost position, i.e. the storage position, by the paper holder 9 when the paper holder 9 is in the closed position. However, when the paper holder 9 is pivoted clockwise or upwardly, the paper guide 12 is pivoted counterclockwise by a biasing force of the paper guide springs 13 and the overhang 12*b* thereof is elevated and comes into contact with the bottom of the paper holder supports 11*c*, whereby the paper guide 12 is stopped in the guiding position in which the paper guide 12 extends obliquely in a rear upward direction to define a paper exit path along which the printed paper is fed from the print mechanism out of the opening 8.

When the operator moves the head release lever 18 for separating the print head 14 from the platen 15 and then inserts a print paper along the paper holder 9, the print paper reaches the pair of paper feed rollers 16 and 17. When the upper and lower paper feed rollers 16 and 17 are then rotated by the paper feed drive, the print paper is guided upwardly by the bottom paper guide 19 and fed between the print head 14 and the platen 15. After coming into contact with the bottom of the overhang 12*b* of the paper guide 12, the print paper is then guided backwardly along the exit path determined by the overhang 12*b*. Thus, the print paper is set in the printing device 7. When the operator moves the print head release lever 18 to bring the print head 14 into close contact with the platen 15 and then operates the keys on the input device 6, the print head 14 is moved along the platen 15 and the appropriate heating elements of the print head 14 are actuated, whereby characters entered through the input device 6 are printed on the print paper.

In order to remove the print paper from the printing device 7, it is only required to move the print head release lever 18 in a direction to separate the print head 14 from the platen 15 and then pull the print paper upwardly therefrom.

To carry the typewriter, pivoting the paper holder 9, which is held in the open position by the paper holder stopper 10, causes the paper guide 12 to be pressed downwardly by the paper holder 9, and pivoted against the biasing force of the paper guide springs 13. Thereafter, by further pivoting the paper holder 9 to bring the paper holder 9 into contact with the top of the paper holder supports 11*c*, the opening 8 is covered with the paper holder 9, and the top surface of the paper holder 9 and the top surface of the paper guide 12 are placed substantially flush with each other, that is, the paper holder 9 and the paper guide 12 do not project upwardly from the main cover 5. When the paper holder 9 and the paper guide 12 are in this storage position, the typewriter is handy to carry.

a paper guide mounted on said covering means adjacent to a front edge of said opening of said main cover for pivotal motion about an axis, said paper guide being retained by a torsion spring in a paper-guiding position when said paper holder is placed in said open position, said paper guide in said paper-guiding position extending obliquely in a rear upward direction from said axis of pivot over said print mechanism to define a paper exit path along which the printed sheet of paper is fed from said print mechanism out of said opening, said paper guide being pushed downwardly by said paper holder and pivoted to a storage position thereof against a biasing force of said torsion spring when said paper holder is pivoted to said closed position.

said paper guide including an extension from said axis of pivot in a direction away from said print mechanism, said extension being located under said auxiliary cover, said torsion spring being wound around said axis of pivot and having a pair of arms, one of said arms being engaged with said extension while the other arm being engaged with a bottom surface of said auxiliary cover.

10. A printing device including a print mechanism wherein a print head is disposed in front of a platen and moves along said platen for printing characters on a sheet of paper which is backed up by said platen and fed perpendicular to a longitudinal direction of said platen, comprising:

covering means including a main cover having an opening which is located above said print mechanism and extends over a printing width of said print mechanism;

a paper holder pivotally mounted on said main cover at a position adjacent to a rear end of said opening, said paper holder being pivotable between a closed position for covering said opening and an open position wherein said paper holder uncovers said opening, said paper holder in said open position supporting and guiding the sheet of paper supplied to said print mechanism; and a paper guide mounted on said covering means adjacent to a front edge of said opening of said main cover for pivotal motion about an axis, said paper guide being retained by a torsion spring in a paper-guiding position when said paper holder is placed in said open position, said paper guide in said paper-guiding position extending obliquely in a rear upward direction from said axis of pivot over said print mechanism to define a paper exit path along which the printed sheet of paper is fed from said print mechanism out of said opening, said paper guide being pushed downwardly by said paper holder and pivoted to a storage position thereof against a biasing force of said torsion spring when said paper holder is pivoted to said closed position, said paper guide including an extension from said axis of pivot in a direction away from said print mechanism, said extension having a protrusion projecting upwardly from a top surface thereof, said protrusion having, in a top end face thereof, a groove which is formed substantially perpendicular to said axis of pivot, said torsion spring being wound around said axis of pivot and having a pair of arms, one of said arms being retained in said groove while the other arm being engaged with said covering member.

11. A printing device including a print mechanism wherein a print head is disposed in front of a platen and moves along said platen for printing characters on a sheet of paper which is backed up by said platen and fed perpendicular to a longitudinal direction of said platen, comprising:

covering means including a main cover having an opening which is located above said print mechanism and extends over a printing width of said print mechanism, and an auxiliary cover which is removably attached to said main cover, said auxiliary cover covering a space communicating with and in front of said opening;

said auxiliary cover having a flat portion and a foot portion at a rear end of said flat portion, said foot portion being spaced a certain distance from said flat portion in a direction perpendicular to a plane of said flat portion, said foot portion being provided with paper holder supports which project upwardly from opposite longitudinal ends of a rear edge thereof;

a paper holder pivotally mounted on said main cover at a position adjacent to a rear end of said opening, said paper holder being pivotable between a closed position for covering said opening and an open position wherein said paper holder uncovers said opening, said paper holder in said open position supporting and guiding the sheet of paper supplied to said print mechanism, said paper holder supports of said foot portion supporting said paper holder in said closed position such that a top surface of said paper holder is substantially flush with a top surface of said flat portion of said auxiliary cover while said foot portion of the auxiliary cover is disposed below a front end of said paper holder, a paper guide mounted on said covering means adjacent to a front edge of said opening of said main cover for pivotal motion about an axis, said paper guide being retained by biasing means in a paper-guiding position when said paper holder is placed in said open position, said paper guide in said paper-guiding position extending obliquely in a rear upward direction from said axis of pivot over said print mechanism to define a paper exit path along which the printed sheet of paper is fed from said print mechanism out of said opening, said paper guide being pushed downwardly by said paper holder and pivoted to a storage position thereof against a biasing force of said biasing means when said paper holder is pivoted to said closed position.

12. A printing device as set forth in claim 11, wherein said paper holder has a notch, which is disposed at an edge thereof remote from a pivot at which said paper holder is mounted on said main cover, said notch facilitating a pivoting motion of said paper holder with a finger.

13. A printing device as set forth in claim 11, wherein said paper guide is held in contact with bottom surfaces of said paper holder supports, so as to act also as a stopper of said paper guide, while the paper guide is located in said paper-guiding position.

* * * * *

What is claimed is:

1. A printing device including a print mechanism wherein a print head is disposed in front of a platen and moves along said platen for printing characters on a sheet of paper which is backed up by said platen and fed perpendicular to a longitudinal direction of said platen, comprising:

covering means including a main cover having an opening which is located above said print mechanism and extends over a printing width of said print mechanism;

a paper holder pivotally mounted on said main cover at a position adjacent to a rear end of said opening, said paper holder being pivotable between a closed position for covering said opening and an open position wherein said paper holder uncovers said opening and extends obliquely in a first rear upward direction away from said print mechanism, said paper holder being pivoted in a first direction from said closed position to said open position to support and guide the sheet of paper supplied to said print mechanism; and a paper guide mounted on said covering means adjacent to a front edge of said opening of said main cover for pivotal motion about an axis, said paper guide being retained by biasing means in a paper-guiding position thereof when said paper holder is in said open position, said paper guide in said paper-guiding position extending obliquely in a second rear upward direction from said axis of pivot over said print mechanism to define a paper exit path along which the printed sheet of paper is fed from said print mechanism out of said opening, said paper guide being pushed downwardly by said paper holder and pivoted in said first direction to a storage position thereof against a biasing force of said biasing means when said paper holder is pivoted to the closed position in a second direction opposite to said first direction.

2. A printing device as set forth in claim 1, wherein said paper holder is a rectangular flat plate.

3. A printing device as set forth in claim 1, wherein said main cover is provided with a holder stopper which contacts said paper holder and prevents a further pivotal motion of said paper holder when said paper holder is pivoted to the position.

4. A printing device as set forth in claim 3, wherein said main cover is provided with a rear wall disposed parallel to a rear edge of said paper holder, said holder stopper comprising a protrusion which projects upwardly from a top surface of a central part of said rear wall and which is formed in a longitudinal direction of said rear wall.

5. A printing device as set forth in claim 1, wherein said paper guide includes an extension which extends from said axis of pivot in a direction away from said print mechanism, said biasing means including a torsion spring which is wound around said axis of pivot and having a pair of arms, one of said arms being engaged with said extension and the other arm thereof being engaged with said covering means.

6. A printing device as set forth in claim 1, wherein said paper guide is warped so as to have an arcuate cross section in a plane perpendicular to a longitudinal direction of said platen.

7. A printing device as set forth in claim 1, which is used with an input device which includes many keys arranged in front of said opening of said main cover, said input device cooperating with the printing device to constitute a typewriter.

8. A printing device including a print mechanism wherein a print head is disposed in front of a platen and moves along said platen for printing characters on a sheet of paper which is backed up by said platen and fed perpendicular to a longitudinal direction of said platen, comprising:

covering means including a main cover having an opening which is located above said print mechanism and extends over a printing width of said print mechanism, said covering means having a pair of pivot holes;

a paper holder pivotally mounted on said main cover at a position adjacent to a rear end of said opening, said paper holder being pivotable between a closed position for covering said opening and an open position wherein said paper holder uncovers said opening, said paper holder in said open position supporting and guiding the sheet of paper supplied to said print mechanism; and a paper guide mounted on said covering means adjacent to a front edge of said opening of said main cover for pivotal motion about an axis, said paper guide being retained by a torsion spring in a paper-guiding position when said paper holder is placed in said open position, said paper guide in said paper-guiding position extending obliquely in a rear upward direction from said axis of pivot over said print mechanism to define a paper exit path along which the printed sheet of paper is fed from said print mechanism out of said opening, said paper guide being pushed downwardly by said paper holder and pivoted in to a storage position thereof against a biasing force of said torsion spring when said paper holder is pivoted to said closed position, said paper guide including an extension from said axis of pivot in a direction away from said print mechanism, said paper guide further including a pair of pivots extending from its opposite ends so as to define said axis of pivot, said pivots being fitted in said pivot holes in said covering means, respectively, said torsion spring being wound around one of said pivots and having a pair of arms, one of said arms being engaged with said extension while the other arm being engaged with said covering means.

9. A printing device including a print mechanism wherein a print head is disposed in front of a platen and moves along said platen for printing characters on a sheet of paper which is backed up by said platen and fed perpendicular to a longitudinal direction of said platen, comprising:

covering means including a main cover having an opening which is located above said print mechanism and extends over a printing width of said print mechanism, and an auxiliary cover which is removably attached to said main cover, said auxiliary cover covering a space communicating with and in front of said opening;

a paper holder pivotally mounted on said main cover at a position adjacent to a rear end of said opening, said paper holder being pivotable between a closed position for covering said opening and an open position wherein said paper holder uncovers said opening, said paper holder in said open position supporting and guiding the sheet of paper supplied to said print mechanism; and